US008777398B2

(12) United States Patent
Toya

(10) Patent No.: US 8,777,398 B2
(45) Date of Patent: Jul. 15, 2014

(54) RECORDING APPARATUS

(75) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 166 days.

(21) Appl. No.: 13/417,669

(22) Filed: Mar. 12, 2012

(65) Prior Publication Data

US 2012/0236100 A1 Sep. 20, 2012

(30) Foreign Application Priority Data

Mar. 18, 2011 (JP) ..... 2011-061365

(51) Int. Cl.
*B41J 2/01* (2006.01)
*B41J 11/00* (2006.01)

(52) U.S. Cl.
CPC ..... *B41J 11/0085* (2013.01)
USPC ..... 347/104

(58) Field of Classification Search
CPC ..... B41J 11/26; B41J 11/27; B41J 11/28; B41J 11/34
See application file for complete search history.

(56) References Cited

U.S. PATENT DOCUMENTS

| | | | | |
|---|---|---|---|---|
| 6,921,163 | B2 | 7/2005 | Fujioka | |
| 7,137,750 | B2 | 11/2006 | Fujioka et al. | |
| 7,204,653 | B2 | 4/2007 | Fujioka et al. | |
| 2007/0296791 | A1 * | 12/2007 | Eve | 347/104 |
| 2008/0073838 | A1 * | 3/2008 | Sakaida | 271/276 |
| 2010/0157006 | A1 | 6/2010 | Kanada et al. | |
| 2011/0050831 | A1 * | 3/2011 | Yamada | 347/215 |

FOREIGN PATENT DOCUMENTS

| | | |
|---|---|---|
| JP | 2002-205855 | 7/2002 |
| JP | 2010-149319 | 7/2010 |

* cited by examiner

*Primary Examiner* — Shelby Fidler
*Assistant Examiner* — Tracey McMillion
(74) *Attorney, Agent, or Firm* — Workman Nydegger

(57) ABSTRACT

An ink jet printer includes a platen in which a plurality of plate members configuring a support surface supporting a roll paper are disposed at a predetermined interval so that suction grooves are formed between the plate members, a recording unit for performing a recording process on the roll paper placed on the support surface, a pressure chamber disposed at the back side of the platen and communicating with the suction grooves, and a suction mechanism for sucking up the roll paper disposed on the support surface through the suction grooves.

5 Claims, 4 Drawing Sheets

RECORDING APPARATUS

INCORPORATION BY REFERENCE

This Application claims the benefit of Japanese Patent Application No. 2011-061365, filed on Mar. 18, 2011, which is hereby incorporated by reference herein in its entirety.

BACKGROUND

1. Technical Field

The present invention relates to a recording apparatus.

2. Related Art

In a recording apparatus such as an ink jet printer, when a recording process is performed on a recording medium such as a recording paper, the recording medium should be supported by a platen to have a predetermined posture (parallel) with respect to a recording head.

In particular, in a case where a roll paper is used as the recording medium, since the end of the roll paper lifts up from the platen due to winding (curl), a paper suction unit for sucking up the roll paper may be provided at the platen in order to prevent the uplift.

A plurality of suction holes is generally provided in the platen, and the paper suction unit sucks up the outside air through each suction hole by a fan mounted to a back side of the platen, so that the roll paper is adsorbed and retained (negative pressure suction) on the platen.

In a case where a recording medium such as a roll paper is placed on the platen and transported, all suction holes may not be covered by the recording medium according to the change of size of the recording medium (the change of dimension in the width direction), a transporting state (location) or the like. In other words, since a suction hole in an open state, not covered by the recording medium, is present, air leaks from the suction hole (air leakage occurs). In addition, if the number of suction holes in such an open state increases, the adsorption force for adsorbing the recording medium is deteriorated, and the uplift of the recording medium is imperfectly suppressed.

For this reason, as disclosed in JP-A-2002-205855, a printer device which includes a shutter mechanism for opening or closing a plurality of suction holes in a stepwise manner in the back side of the platen in which the plurality of suction holes are formed, so that the shutter mechanism is operated according to the transporting state of the recording medium or the like.

In JP-A-2002-205855, the outside air is sucked up through the plurality of suction holes formed in the platen, and the recording medium may be adsorbed to the surface of the platen, but the processing work for forming a plurality of adsorption holes in a plate which becomes the base material of the platen requires time or cost.

SUMMARY

An advantage of some aspects of the invention is to provide a recording apparatus which may suppress an increase in costs and reliably adsorb and retain a recording medium.

According to an aspect of the invention, there is provided a recording apparatus including a medium support unit having suction grooves formed between a plurality of plate members disposed at a predetermined interval and configuring a medium support surface supporting a recording medium; a record processing unit for performing a recording process on the recording medium transported in the transporting direction and placed on the medium support surface; a pressure chamber disposed at the back side of the medium support unit and communicating with the suction grooves; and a suction mechanism for sucking the recording medium disposed on the medium support surface through the suction grooves.

In the invention, the suction grooves may be formed between the plate members according to the cutout shape of the plate members. Even though the working process for forming suction grooves in a medium support unit is very costly, the invention reduces costs since the hole perforating process is not required.

In addition, the suction grooves may extend in a direction intersecting the transporting direction.

By doing so, the width direction (the entire region) intersecting the transporting direction of the recording medium may be adsorbed to the medium support surface, and so the flatness of the recording medium may be maintained and it is possible to prevent the recording quality from deteriorating.

In addition, at least a part of the suction grooves may extend along the transporting direction.

By doing so, the adsorbing region (range) may spread in the transporting direction of the recording medium, and so the recording medium may be reliably adsorbed and retained to the medium support surface.

In addition, protruding portion protruding in the surface direction toward other plate members adjacent to each other and having shapes opposite to the other plate members may be installed at the plurality of plate members, so that the protruding portion of the plate members adjacent to each other are associated with each other.

By doing so, just by disposing the plate members, the suction grooves along any of the extending direction of the transporting direction and the direction intersecting the transporting direction may be easily formed, and so the recording medium may be reliably adsorbed and retained to the medium support surface.

In addition, the plurality of plate members may have a comb tooth shape in a plan view, so that the associated protruding portion of the plate members adjacent to each other may be disposed to engage each other.

By doing so, by configuring the plate members to engage each other (a fitting structure), the shape of the suction grooves in a plan view may be complicated, and so the adsorbing and retaining state of the recording medium to the medium support surface may be maintained more reliably.

In addition, the suction grooves may extend with a slope with respect to the transporting direction.

By doing so, when the recording medium is transported to the medium support surface, it is possible to prevent the recording medium from being stuck by the suction grooves.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to the drawings. In addition, in each drawing used for the following description, the scale of each member is suitably changed so that each member may have a recognizable size.

First Embodiment

Figure 1:
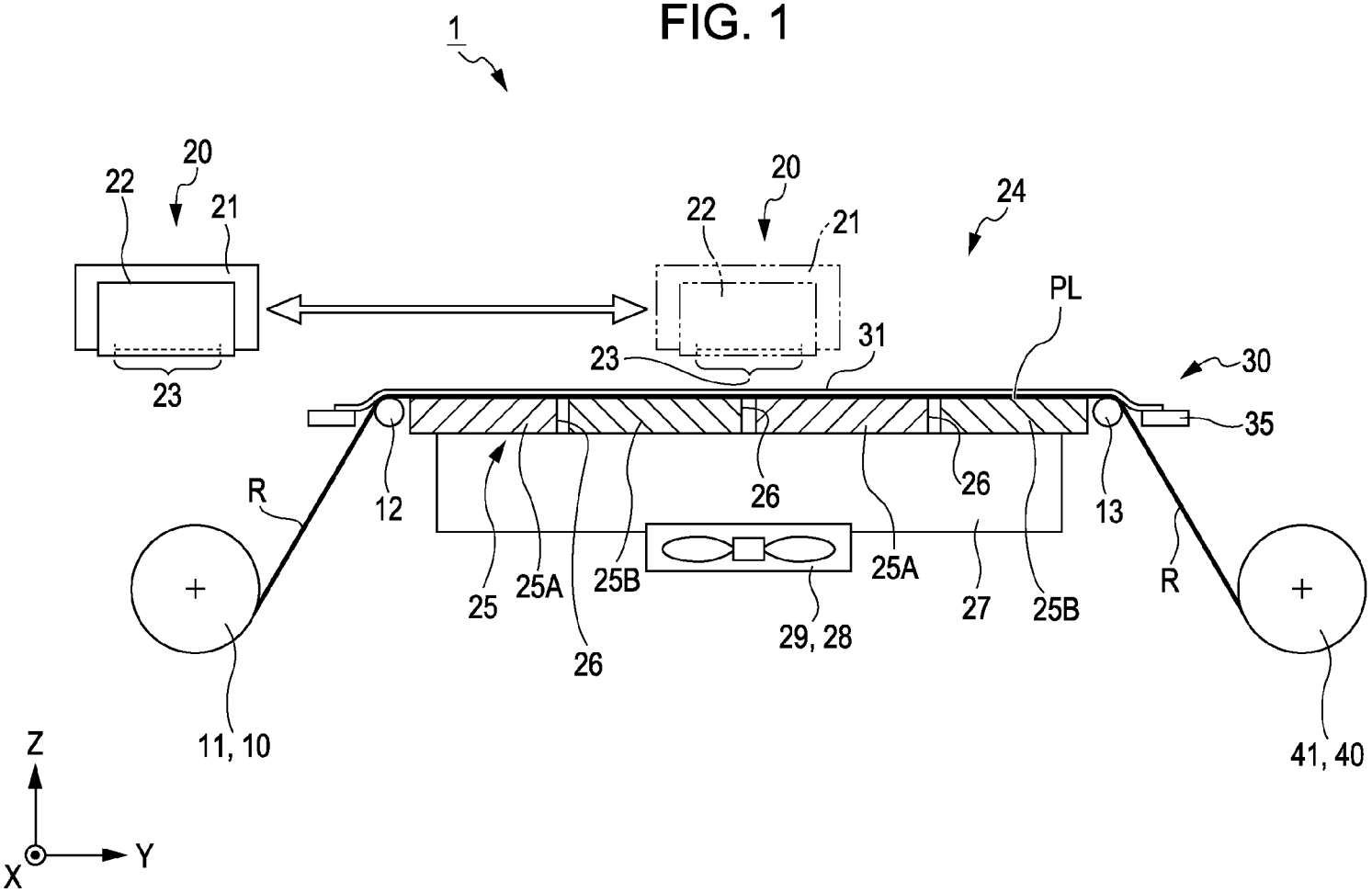
FIG. 1 is a side view showing a schematic configuration of an ink jet printer according to an embodiment.

FIG. 1 is a side view showing a schematic configuration of an ink jet printer 1 according to this embodiment.

As shown in FIG. 1, the ink jet printer (a recording apparatus) 1 includes a transporting unit 10, a recording unit (a record processing unit) 20 and a discharging unit 40.

The transporting unit (a medium transporting unit) 10 is installed to transport a roll paper (recording medium) R, which is one example of a recording medium to the recording unit 20. In detail, a roll medium holder 11 is provided so that the roll medium holder 11 retains a roll-shaped roll paper R. In addition, by rotating the roll-shaped roll paper R, a first roller 12 is interposed to the recording unit 20 at a downstream side in the transporting direction (the arrow direction on the Y axis), and it is configured so that a roll paper R whose roll state is released may be transported.

The recording unit 20 is installed to discharge ink, which is an example of a liquid, to the roll paper R sent from the transporting unit 10 and perform recording.

In detail, the recording unit 20 includes a carriage 21, a recording head 22, a medium support table 24, a curl pressing unit 30 or the like.

The carriage 21 is installed to be guided toward a medium support table 24 by a second guide shaft (not shown) and to move in the transporting direction Y of the roll paper R by the power of a carriage motor (not shown).

In addition, FIG. 1 shows a state where the carriage 21 retreats to an upstream side in the transporting direction further to the medium support table 24.

In addition, the recording head 22 is installed at the carriage 21 and installed to move in the transporting direction Y integrally with the carriage 21.

Further, the recording head 22 is configured to relatively move in the width direction X with respect to the carriage 21. In detail, the recording head 22 is installed to be guided by a second guide shaft (not shown) and move by the power of a recording head (not shown) in the width direction X.

In other words, the recording head 22 is configured to be movable in the Y direction (a vertical scanning direction) which is the transporting direction and in the X direction (a main scanning direction) which is the width direction, for a region opposite to the medium support table 24.

In addition, ink is discharged from a nozzle row 23 installed at the surface of the recording head 22, opposite to the medium support table 24, to perform recording on the roll paper R.

The medium support table (a medium adsorption support device) 24 is installed to support the roll paper R from the back surface. In detail, the medium support table 24 includes a platen (a medium support unit) 25 supporting the roll paper R, a pressure chamber 27 disposed at the back surface side of the platen 25, and a suction mechanism 28 connected to the pressure chamber 27.

Figure 2:
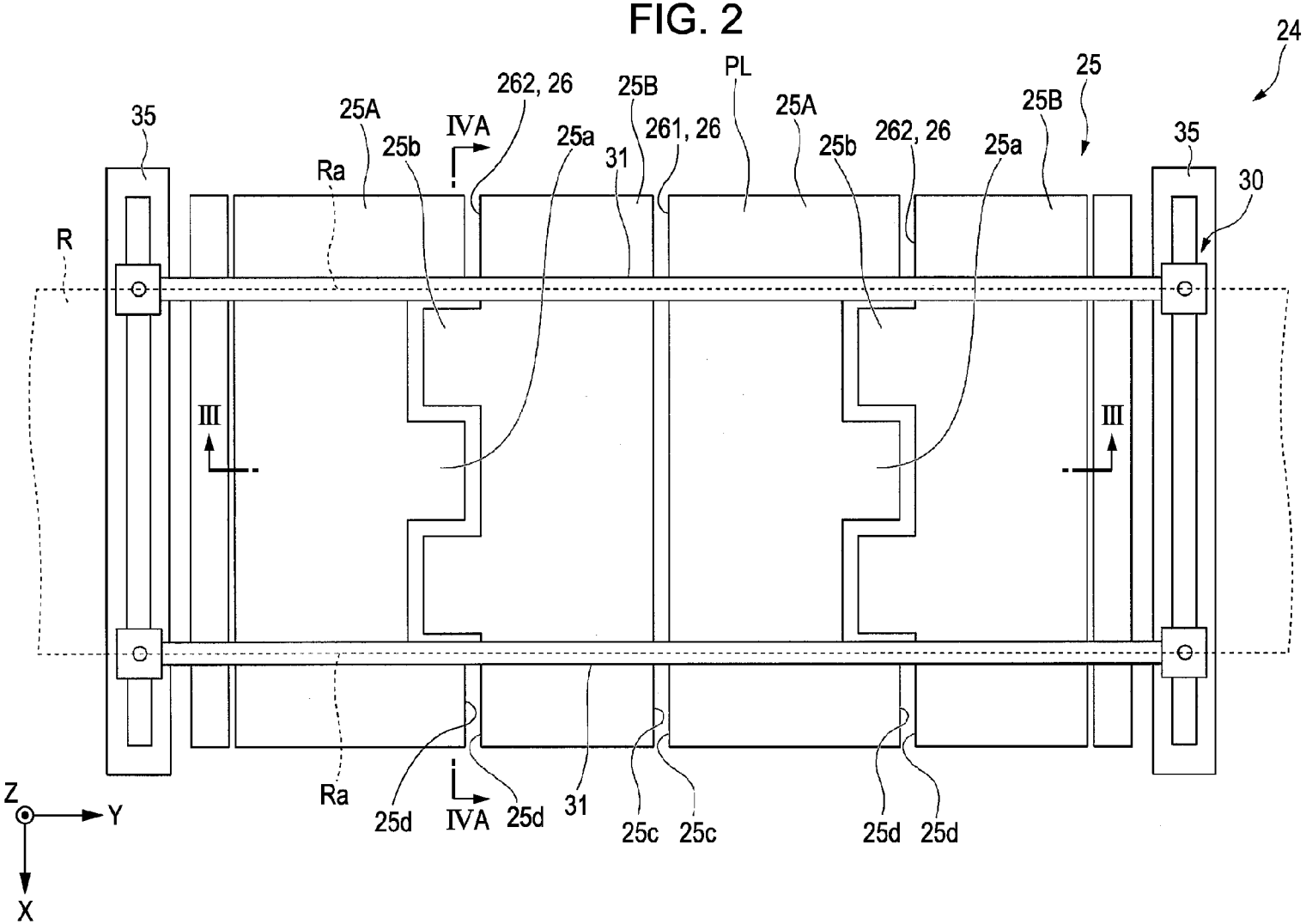
FIG. 2 is a surface view showing a schematic configuration of a platen.

As shown in FIG. 1, a plurality of suction grooves 26 (three grooves in this embodiment) are installed to the platen 25 at predetermined intervals, for example, in the transporting direction of the roll paper R. These suction grooves 26 have a width of several millimeters in the transporting direction of the roll paper R, and extend over the entire portion in a direction intersecting the transporting direction of the roll paper R. As shown in FIG. 2, the platen 25 of this embodiment includes a plurality of plate members 25A and 25B so that the suction grooves 26 are formed between these plate members 25A and 25B.

The pressure chamber 27 is a sealed space whose upper surface is the platen 25, and the suction mechanism 28 is connected to its bottom surface or side surface.

The suction mechanism 28 is configured to suck the air in the pressure chamber 27. By doing so, the outside air is sucked through the plurality of suction grooves 26 of the platen 25, and the roll paper R placed on the support surface (the medium support surface) PL of the platen 25 is adsorbed and retained to the support surface PL of the platen 25.

The curl pressing unit 30 presses the side end Ra (FIG. 2) of the roll paper R placed on the support surface PL of the platen 25 toward the platen 25, thereby preventing the side end Ra (FIG. 2) of the roll paper R from curling and separating from the platen 25, so-called uplifting.

In detail, the curl pressing unit 30 has a curl pressing member 31 made of a pair of band-type films with pliability and flexibility. Each curl pressing member 31 is disposed over the entire portion in the Y direction along the Y direction (the transporting direction of the roll paper R) at both end sides of the platen 25 in the X direction (both ends of the roll paper R in the width direction).

In addition, the curl pressing member 31 has a thickness of, for example, 0.5 mm or less, and a width of about 30 mm. In addition, as its material, for example, a polyimide or the like may be used.

Both ends of each curl pressing member 31 (ends in the Y direction) are respectively connected to a curl pressing attaching unit 35. The curl pressing attaching unit 35 is respectively a member having substantially the same length as the width direction (X direction) of the platen 25, and at a location separated from the end of the longitudinal direction (Y direction) of the platen 25, the curl pressing attaching unit 35 is fixed to a base body unit (not shown) of the ink jet printer 1 along the width direction.

In addition, the curl pressing attaching unit 35 connects both ends of the curl pressing member 31 to be movable respectively along the X direction. By doing so, each curl pressing member 31 moves both ends along the curl pressing attaching unit 35, so as to be disposed in parallel to the longitudinal direction (Y direction) of the platen 25 at a position in the width direction (X direction) of the platen 25.

Therefore, it is possible to press both ends in the width direction (X direction) of the roll paper R placed on the surface of the platen 25 over the entire portion of the longitudinal direction (Y direction).

The discharging unit 40 is configured to have a wind-up roller 41, so that the roll paper R sent from the recording unit 20 is wound around the wind-up roller 41.

In addition, when winding the roll paper R sent from the recording unit 20 to be wound around the roller 41, the discharging unit 40 may have a tensioner for removing bending of the roll paper R, or a drying unit for heating and drying the roll paper R sent from the recording unit 20.

Next, configuration of the platen will be described in detail.

Figure 3:
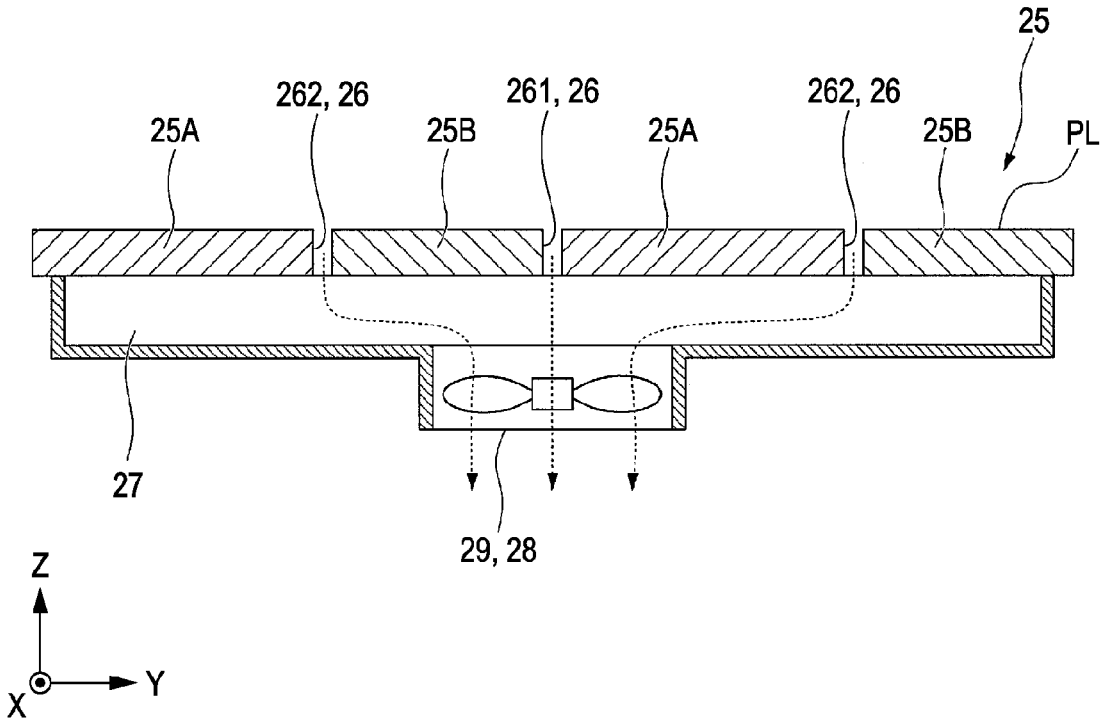
FIG. 3 is a cross-sectional view showing a configuration of a configuration of a medium support table based on the platen.

FIG. 2 is a surface view showing a schematic configuration of the platen, and FIG. 3 is a cross-sectional view showing a configuration of a medium support table based on the platen.

As shown in FIG. 2, in the platen 25, convex portions 25*a* and 25*b* protruding in the surface direction toward other plate members adjacent to each other and having shapes opposite to other plate members are installed at the plurality of plate members 25A and 25B, and thus the plate members 25A and 25B are disposed so that the convex portions 25*a* and 25*b* are associated with each other.

In this embodiment, as shown in FIGS. 2 and 3, two kinds of plate members 25A and 25B having different planar shapes are provided by twos, respectively, so that the plate member 25A and the plate member 25B are alternately disposed along the transporting direction of the roll paper R (Y direction). The plate members 25A and 25B have comb tooth shapes in a plan view where one is a male shape and the other is a female shape, and are separated from each other in the transporting direction of the roll paper R.

In detail, the plate member 25A has an attitude where a plurality of (three) convex portions (protruding portion) 25*a* are oriented toward the downstream side in the transporting direction, and the plate member 25B has an attitude where a plurality of (two) convex portions 25*b* are oriented toward the upstream side in the transporting direction, so that, in each of the plate members 25A and 25B, the convex portions 25*a* and 25*b* mesh each other in a state of being engaged and are disposed with a gap between them. By doing so, a plurality of suction grooves 26 are formed between the plurality of plate members 25A and 25B arranged in the transporting direction.

Among the plurality of suction grooves 26, the suction groove 261 (26) formed between side portions 25*c* of the plate members 25A and 25B adjacent to each other is shaped similar to the side portion 25*c*, and formed linearly along a direction intersecting the transporting direction of the roll paper R.

Meanwhile, the suction groove 262 (26) formed between side portions 25*d* having the convex portions 25*a* and 25*b* of the plate members 25A and 25B adjacent to each other is formed with a hook shape similar to the appearance of each of the convex portions 25*a* and 25*b*. By doing so, since a part of the suction groove 262 (26) extends along the transporting direction of the roll paper R, a paper adsorbing region increases in the transporting direction to prevent the roll paper R from lifting, and the roll paper R may be favorably adsorbed to the support surface PL of the platen 25.

Further, the convex portion 25*a* and 25*b* may also be installed to each side portion 25*c* of the plate members 25A and 25B disposed at the inside. The paper adsorption force in the transporting direction is improved by forming the suction groove 261 between every plate members 25A and 25B adjacent to each other as described above.

In addition, the planar shape and number of the convex portion 25*a* and 25*b* in this embodiment are not limited to the above. For example, the shape of the convex portions 25*a* and 25*b* may be modified so as to form suction grooves extending with a slope with respect to the transporting direction of the roll paper R. By doing so, when the roll paper R is transported onto the platen 25, the end of the roll paper R sticking to the suction grooves are prevented.

The platen 25 of this embodiment as described above includes a heater (not shown) for heating and drying the roll paper R on which a recording process is performed. Each of the plate members 25A and 25B is formed to have a thickness of 25 mm, and the heater is embedded at each back side. The thickness of the plate members 25A and 25B is set according to the balance with the kind of the heater embedded. It may be conceived that a heater is bonded to the back side of a plate member with a thickness of about 2 to 3 mm, but durability is weakened and inconvenience such as peeling-off and lifting occurs. Therefore, mist or the like of ink may leaks into the gap between the plate members 25A and 25B and the heater, which may burn the heater. For this reason, the heater is mechanically embedded in each of the plate members 25A and 25B, which ensures excellent durability and extends service life.

Next, operation of the ink jet printer 1 will be described.

Figure 4A:
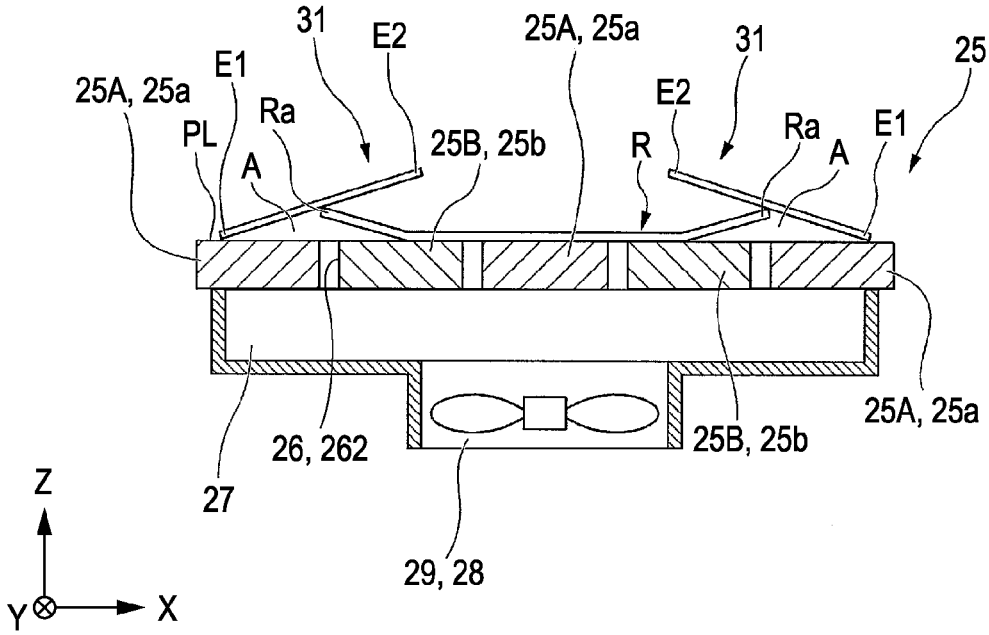
FIGS. 4A and 4B are cross-sectional views showing a schematic configuration for illustrating operations when a suction mechanism is operated.
Figure 4B:
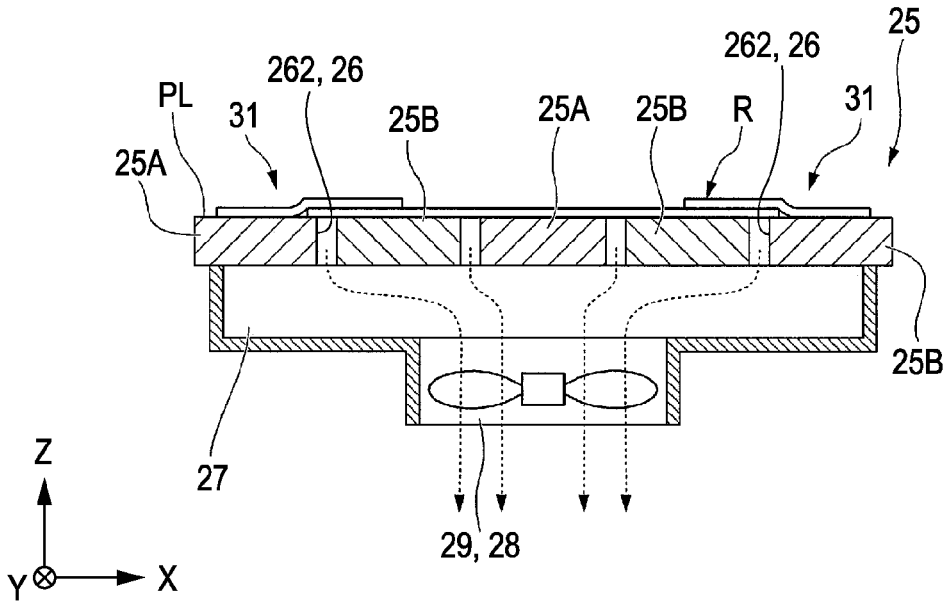

FIGS. 4A and 4B are cross-sectional views showing a schematic configuration for illustrating operations when a suction mechanism is operated, where FIG. 4A shows the suction mechanism before operation and FIG. 4B shows the suction mechanism after operation, respectively.

First, as shown in FIG. 4A, in a state where the roll paper R is sent onto the platen 25, an operator matches locations of a pair of curl pressing members 31 in the X direction to be opposite to the side end Ra of the roll paper R.

In detail, the curl pressing member 31 is disposed to cover the side end Ra of the roll paper R. In other words, the curl pressing member 31 is disposed across (to cover) the side end Ra of the roll paper R. In this way, the outer side end E1 of the curl pressing member 31 makes contact with the platen 25 at the outer side further to the side end Ra of the roll paper R. Meanwhile, the inner end E2 of the curl pressing member 31 is located further inward than the side end Ra of the roll paper R to contact the side end Ra of the roll paper R.

Since a downward pressing force is applied to one pair of the curl pressing members 31, the outer side end E1 may make at least linear contact with the platen 25. Similarly, the surface of one pair of curl pressing members 31 at the inner end E2 side may make contact with the side end Ra of the roll paper R.

In addition, as described above, the plurality of suction grooves 26 are installed in the region opposed to at least the side end Ra of the roll paper R and the curl pressing member 31, with respect to the support surface (medium support surface) PL of the platen 25. In this state, the suction mechanism 28 connected to the pressure chamber 27 of the medium support table 24 is operated, and an axial flow fan 29 is rotated to form negative pressure in the pressure chamber 27. Then, air (outside air) at the support surface PL side of the platen 25 is sucked through all suction grooves 26 of the platen 25, and the air in the space A surrounded by the platen 25, the roll paper R and the curl pressing member 31 is sucked through the suction grooves 26.

Then, as shown in FIG. 4B, the roll paper R and one pair of curl pressing member 31 make close contact with the platen 25, in other words, is adsorbed and retained to the support surface PL. In this state, the roll paper R placed on the support surface PL of the platen 25 may be adsorbed and retained to the support surface PL of the platen 25. In particular, by providing one pair of curl pressing members 31, both side ends Ra of the roll paper R may make close contact with the platen 25.

As described above, by sucking air on the platen 25 through the plurality of suction grooves 26 of the platen 25 by means of the operation of the suction mechanism 28, the roll paper R may be adsorbed and retained to the support surface PL of the platen 25.

Since the ink jet printer 1 of this embodiment as described above includes the platen 25 composed of the plurality of plate members 25A and 25B cut with a comb tooth shape in a plan view, a suction force may be applied to the roll paper R disposed on the support surface PL through the suction grooves 26 formed between the plate members 25A and 25B.

In other words, by disposing the plurality of the plate members 25A and 25B to be separated from each other, the suction grooves 26 are formed according to the cutout shape of each of the plate members 25A and 25B. For this reason, as in the related art, without having to form a suction hole in a large plate, the suction grooves 26 may be easily formed by disposing the plurality of plate members 25A and 25B. In addition, even though the working process for forming a suction hole in plate material is very costly, the invention reduces costs since the hole perforating process is not required.

In addition, in the suction grooves 26, in order to be formed over the entire region in the traverse direction of the platen 25

(a direction intersecting the transporting direction of the roll paper R), the entire region in the width direction intersecting the transporting direction of the roll paper R may be adsorbed to the support surface PL. By doing so, the flatness of the roll paper R may be maintained, and so it is possible to prevent the printing accuracy from deteriorating.

In addition, since the suction grooves 26 extend along the entire region in the transporting direction of the roll paper R, the entire region in the width direction intersecting the transporting direction of the roll paper R may be adsorbed to the support surface PL, and so the flatness of the roll paper R may be maintained and it is possible to prevent the recording quality from deteriorating.

In addition, in this embodiment, the plurality of plate members 25A and 25B have a comb tooth shape in a plan view, and so the plate members 25A and 25B adjacent to each other are disposed to engage each other. By configuring the plate members 25A and 25B to engage each other (fitting structure) as described above, the shape of the suction grooves 26 in a plan view may be complicated, and so the adsorbing area of the roll paper R to the support surface PL may spread to maintain the adsorbing and retaining state more reliably. In addition, since at least a part of the suction groove 262 (26) formed with a hook shape extends in the transporting direction along the convex portion 25*a* and 25*b* of the plate members 25A and 25B, the adsorbing region (range) spreads in the transporting direction of the roll paper R, thereby reliably maintaining suction by closely adhering the roll paper R to the support surface PL.

In addition, the shape of the suction grooves 26 in a plan view is not limited to the above, but the shape of the plurality of plate members in a plan view may be set to configure the platen 25 so that at least a part of the suction grooves 26 extends in the transporting direction.

In addition, the shape of the plate member in a plan view may be set so that the suction grooves 26 may extend with a slope with respect to the transporting direction. By doing so, when the roll paper R is transported onto the support surface PL, it is possible to prevent the roll paper R from being stuck by the suction grooves 26.

Heretofore, a preferred embodiment of the invention has been described with reference to the accompanying drawings, but it is obvious that the invention is not limited to the embodiment. To those skilled in the art, it is apparent that, within the scope of technical spirit described in the claims, various changes or modifications can be made, and they are also understood as belonging to the scope of the invention.

For example, even though the platen 25 is configured with the plurality of plate members 25A and 25B having a comb tooth shape in a plan view, it is also possible that the plurality of plate members having a rectangular shape in a plan view are arranged side by side in the transporting direction of the roll paper R, so that suction grooves extending linearly are formed between the plate members in a direction intersecting the transporting direction. In other case, the plurality of plate members may be configured to fit in a puzzle shape.

In addition, the shape of the plate member in a plan view is not limited to the above.

In addition, the number of the axial flow fan 29 of the suction mechanism 28 is not limited to 1, but it may be provided in plural.

Further, even though it has been described in the above embodiment that the ink jet printer is an example of the recording apparatus (the liquid ejecting apparatus), the recording apparatus may be a copier, a facsimile or the like, without being limited to the ink jet printer.

In addition, even though it has been described in the above embodiment that the roll paper R is an example of the recording medium, the recording medium may also be a single ticket paper or a film material.

In addition, even though it has been described in the above embodiment that a liquid ejecting apparatus for ejecting liquid such as ink is an example of the recording apparatus, it may be applied to a liquid ejecting apparatus which ejects or discharges liquid other than ink. Liquid ejectable by the liquid ejecting apparatus includes liquid-state and gel-state fluid where particles of functional material are disperse and dissolved.

In addition, in the above embodiment, the liquid ejected from the liquid ejecting apparatus (the recording apparatus) may be not only ink, but also a liquid corresponding to a particular application. An ejecting head capable of ejecting the liquid corresponding to the particular application may be provided to the liquid ejecting apparatus so that the liquid corresponding to the particular application is ejected from the ejecting head, and the liquid may be attached to a predetermined article to manufacture a predetermined device. For example, the liquid ejecting apparatus may be applied to a liquid ejecting apparatus which ejects liquid (liquid-state material) where a material such as an electrode material, colorant material or the like used for manufacturing a liquid crystal display, an EL (electroluminescence) display, and a field emission display (FED) is dispersed (dissolved) in a dispersion medium (solvent).

In addition, the fluid ejecting apparatus may be a liquid ejecting apparatus for ejecting a bio organic material used for manufacturing a bio chip, or a liquid ejecting apparatus used as a precise pipette and ejecting a liquid sample.

Further, it may be a liquid ejecting apparatus for ejecting a lubricant with a pin point to precision machines such as watches and cameras, a liquid ejecting apparatus for ejecting a transparent resin liquid such as ultraviolet curable resin onto a substrate in order to form a micro-hemisphere lens (an optical lens) or the like used for an optical communication device or the like, a liquid ejecting apparatus for ejecting an etching liquid such as acid or alkali to etch a substrate or the like, or a fluid-state material ejecting apparatus for ejecting a gel. In addition, the invention may be applied to any kind of the liquid ejecting apparatuses.

What is claimed is:

1. recording apparatus, comprising:

a medium support unit having suction grooves formed between a plurality of plate members disposed at a predetermined interval and configuring a medium support surface supporting a recording medium;

a record processing unit for performing a recording process on the recording medium transported in a transporting direction and placed on the medium support surface;

a pressure chamber disposed at the back side of the medium support unit and communicating with the suction grooves; and a suction mechanism for sucking up the recording medium disposed on the medium support surface through the suction grooves, wherein each of the plate members include a plurality of protruding portions protruding in the transporting direction, wherein the protruding portions of adjacent plates are offset from each other in a direction perpendicular to the transporting direction.

2. The recording apparatus according to claim 1, wherein the suction grooves extend in a direction intersecting the transporting direction.

3. The recording apparatus according to claim 1, wherein at least a part of the suction grooves extends along the transporting direction.

4. The recording apparatus according to claim 1, wherein the plurality of plate members have a comb tooth shape in a plan view, so that the associated protruding portions of the plate members adjacent to each other are disposed to engage each other.

5. The recording apparatus according to claim 1, wherein the suction grooves extend with a slope with respect to the transporting direction.

* * * * *